US007594666B2

(12) United States Patent
Wegener

(10) Patent No.: US 7,594,666 B2
(45) Date of Patent: Sep. 29, 2009

(54) SKATE ASSEMBLY

(75) Inventor: Andreas C. Wegener, Vista, CA (US)

(73) Assignee: Sunshine Distribution, Inc., Vista, CA (US)

( * ) Notice: Subject to any disclaimer, the term of this patent is extended or adjusted under 35 U.S.C. 154(b) by 444 days.

(21) Appl. No.: 11/451,901

(22) Filed: Jun. 13, 2006

(65) Prior Publication Data

US 2007/0284836 A1 Dec. 13, 2007

(51) Int. Cl.

| | |
|---|---|
| ***A63C 17/18*** | (2006.01) |
| ***A63C 1/00*** | (2006.01) |
| ***A63C 3/00*** | (2006.01) |
| ***A63C 17/00*** | (2006.01) |
| ***A43B 3/18*** | (2006.01) |
| ***A43B 5/16*** | (2006.01) |

(52) U.S. Cl. ..... 280/11.15; 280/7.12; 280/7.13; 280/11.12; 280/842; 280/843; 280/844; 280/11.19; 280/11.3; 280/11.32; 280/11.31; 280/11.33; 36/7.2; 36/7.4; 36/7.7; 36/7.3; 36/7.5; 36/7.6; 36/122; 36/123; 36/124; 36/125

(58) Field of Classification Search ..... 280/7.12, 280/7.13, 7.14, 11.12, 600, 601, 603, 607, 280/11.14, 11.15, 842, 843, 844, 11.19, 11.3, 280/11.31, 11.32, 11.33, 611, 613, 614, 615, 280/617, 618, 623, 625, 14.21, 14.22, 14.23; 36/7.2, 7.4, 7.7, 7.3, 7.5, 7.6, 122–125
See application file for complete search history.

(56) References Cited

U.S. PATENT DOCUMENTS

| | | | | |
|---|---|---|---|---|
| 3,526,976 | A * | 9/1970 | Jacobs | 36/100 |
| 5,549,310 | A * | 8/1996 | Meibock et al. | 280/11.221 |
| 5,845,927 | A * | 12/1998 | Steinhauser, Jr. | 280/7.14 |
| 5,887,877 | A * | 3/1999 | Nero | 280/11.221 |
| 5,950,333 | A * | 9/1999 | Tsen | 36/7.1 R |
| 5,970,631 | A | 10/1999 | Inman | |
| 6,006,450 | A | 12/1999 | Hayes | |
| 6,029,983 | A | 2/2000 | Wegener | |
| 6,041,525 | A | 3/2000 | Kelley | |
| 6,070,886 | A | 6/2000 | Cornelius et al. | |
| 6,115,946 | A | 9/2000 | Morris et al. | |
| 6,151,806 | A | 11/2000 | Morris et al. | |
| 6,158,150 | A | 12/2000 | Morris et al. | |
| 6,164,669 | A | 12/2000 | Svensson | |
| 6,195,918 | B1 | 3/2001 | Kelley et al. | |
| 6,195,920 | B1 | 3/2001 | Morris et al. | |
| 6,217,035 | B1 * | 4/2001 | Steinhauser, Jr. | 280/7.14 |

(Continued)

FOREIGN PATENT DOCUMENTS

| | | |
|---|---|---|
| EP | 0 551 704 A2 | 10/1992 |

*Primary Examiner*—Christopher P Ellis
*Assistant Examiner*—John R Olszewski
(74) *Attorney, Agent, or Firm*—Procopio, Cory, Hargreaves & Savitch LLP

(57) ABSTRACT

A skate assembly has a boot having a substantially completely open base with a sole plate of more rigid material than the boot secured over the open base. The base has an opening extending along at least substantially the entire length of the boot from the heel to the toe, with side rims extending along opposite sides of the base opening. The sole plate may be releasably or permanently secured to the boot.

25 Claims, 9 Drawing Sheets

U.S. PATENT DOCUMENTS 6,226,900 B1 5/2001 Mazars
6,247,251 B1 6/2001 James
6,321,467 B1 * 11/2001 Tsen ..... 36/97
6,467,198 B1 10/2002 James
6,648,346 B2 11/2003 Borel
6,851,683 B2 2/2005 Wegener
6,863,284 B2 * 3/2005 Wegener, Andreas C. ..... 280/11.231
6,932,360 B2 8/2005 Wegener et al.
2001/0013695 A1 * 8/2001 Borel ..... 280/607

* cited by examiner

SKATE ASSEMBLY

BACKGROUND

1. Field of the Invention

The present invention relates generally to skates in which a sole plate or frame is attached to the base of the boot, and wheels or rollers are in turn secured to the sole plate or frame.

2. Related Art

In order to allow some degree of movement of the skater's foot, existing skate boots are made of a semi-flexible or semi-soft material. The soft boot material produces a slower grinding speed on surfaces such as concrete curbs or steel rails, and also allows unwanted flex of the boot. These problems have been solved in the past by attaching glider plates of faster and harder material to the underside of the boot or a platform or sole plate that covers a large portion of the underside of the boot. Glider plates do not solve the problem of flexing of the boot base, while sole plates add unwanted height between the foot and the ground. The two layers between the wearer's foot and the ground also reduces the wearer's feel and control of the skate.

SUMMARY

It is an object of the present invention to provide a new skate assembly which has a baseless boot.

According to one aspect of the present invention, a skate assembly is provided, which comprises a boot having a heel, a toe, opposite sides, and an open base having an opening extending from the heel to the toe and side rims extending along opposite sides of the base opening, at least a substantial part of the boot being made of a first material, and a sole plate secured across the open base of the boot, the sole plate being made of a second material which is more rigid than the first material.

In the assembled skate, a glide device is attached to the lower surface of the sole plate. The skate assembly may be an in-line skate with the gliding device comprising a frame with a row of wheels or rollers rotatably mounted on the frame, a conventional roller skate with a frame carrying spaced pairs of aligned rollers, or an ice skate with a blade.

The design of the skate assembly with an open or baseless boot avoids the problem of a flexible boot base. Since the boot is open at the base and attached directly to the sole plate, the overall height of the boot remains the same, and there is only one layer of material (the sole plate) between the wearer's foot and the ground engaging glide member or members (rollers or blades). This may improve the skater's feel and control of the skate movement.

In one embodiment of the invention, the sole plate is releasably attached to the boot. In this embodiment, the side rims extending on opposite sides of the base opening have fastener openings, and the sole plate has corresponding fastener openings which are aligned with the side rim openings when the parts are assembled. Suitable releasable fasteners extend through the aligned openings to releasably secure the sole plate to the boot. The side rim openings may be recessed for receiving T-nuts which engage bolts extending through the aligned openings. In an alternative embodiment of the invention, the sole plate may be permanently secured over the open base of the boot, by stitching or the like.

In an exemplary embodiment where the sole plate is removably secured to the boot, the sole plate or frame has a raised peripheral rim extending around at least part of its perimeter. One side of the peripheral rim and the corresponding side portion of the boot have mateable formations for releasable engagement when the sole plate is engaged over the open base of the boot. The formations may be inwardly projecting tabs on the sole plate rim for engagement in corresponding openings on the side portion of the boot.

One or more sliders or grind plates may be provided for securing on the outer side face of the boot. The sliders are made of a suitable durable, smooth-surfaced material designed to resist abrasion when the skater uses the sliders to slide against a suitable grinding or sliding edge. In this embodiment, the grind plates have base portions with openings for alignment with corresponding fastener openings in the corresponding side rim of the open base and in the sole plate, so that the same fasteners extend through all three aligned openings at each fastener location. The grind plates may also have inwardly projecting tabs for extending through corresponding openings in the adjacent outer side portion of the boot. In this arrangement, the grind plates will also help to hold the boot and sole plate together. In alternative embodiments, grind regions may be formed integrally with the outer side of the sole plate or boot.

In another embodiment of the invention, the sole plate is permanently secured over the base of the boot to cover the opening by means of stitching or the like. The sole plate in this case may have a raised rim extending around at least part of its periphery which engages over the corresponding lower rim of the boot, and a recessed area or groove may be provided around the rim for receiving the stitching.

Other features and advantages of the present invention will become more readily apparent to those of ordinary skill in the art after reviewing the following detailed description and accompanying drawings.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Figure 1:
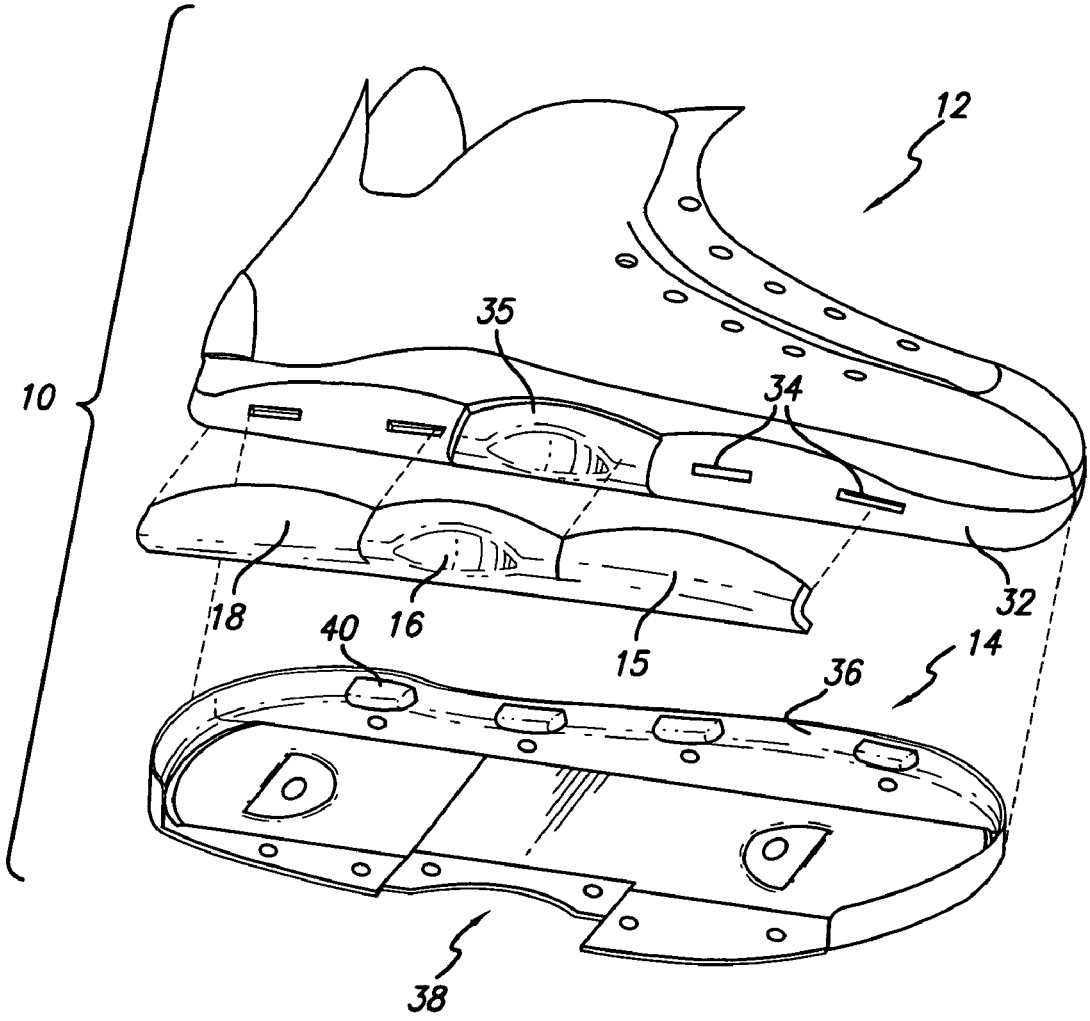
FIG. 1 is a exploded perspective view illustrating the separated components of a skate boot assembly according to an exemplary embodiment of the present invention.

Certain embodiments as disclosed herein provide for a skate boot assembly with a baseless boot. For example, one embodiment as disclosed herein allows for a sole plate of more rigid material to be releasably secured over the open base of a boot.

After reading this description it will become apparent to one skilled in the art how to implement the invention in various alternative embodiments and alternative applications. However, although various embodiments of the present invention will be described herein, it is understood that these embodiments are presented by way of example only, and not limitation. As such, this detailed description of various alternative embodiments should not be construed to limit the scope or breadth of the present invention as set forth in the appended claims.

FIGS. 1 to 11 of the drawings illustrate a skate boot assembly 10 according to a first embodiment of the invention which may form part of an in-line skate or a conventional skate. FIGS. 1 to 11 illustrate a right boot assembly, and it will be understood that a left boot assembly will be made in a corresponding manner with appropriate reversal of structures for fitting over the left foot of a wearer. The assembly 10 basically comprises a boot 12, a sole plate or frame 14 for securing over the base of the boot, and a set of sliders for securing over the outer side rim of the assembled boot and sole plate, the sliders comprising a front slider 15, a backslide plate 16 similar to the backslide plate described in my U.S. Pat. No. 6,863,284, the contents of which are incorporated herein by reference, and a rear slider 18. The components are shown assembled in FIG. 9. It will be understood that a glide frame (not illustrated) will be secured to the lower face of the sole plate, using central guide slot 20 and mounting holes 22 (FIG. 7), in a manner known in the field. The glide frame will have a row of downwardly depending, rotatably mounted wheels or rollers.

Figure 2:
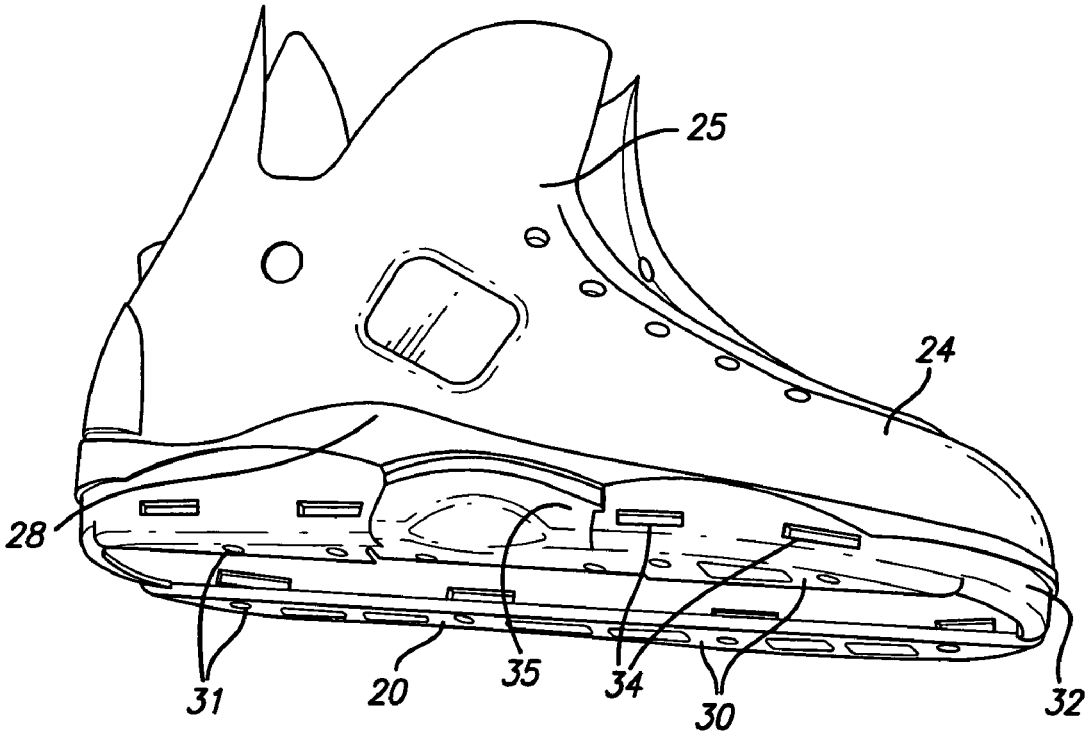
FIG. 2 is a lower perspective view of the boot of FIG. 1, illustrating the open base of the boot.
Figure 4:
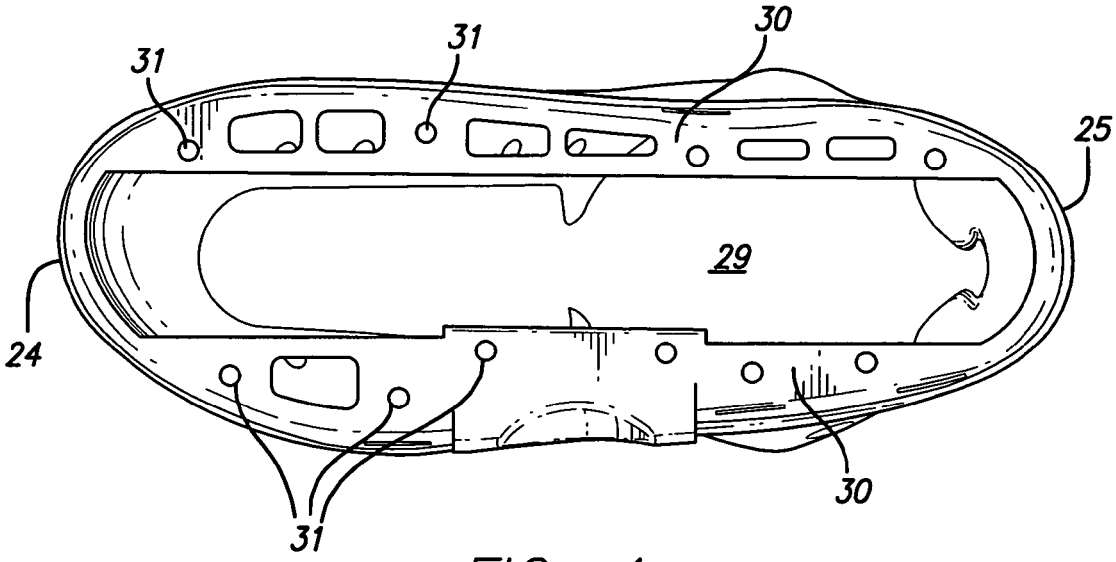
FIG. 4 is a lower plan view of the boot.

The skate boot 12 will be made of relatively soft and semi-flexible material for the comfort of the wearer and also to allow a certain amount of movement of the foot when the skate is in use, as is known in the field. The boot material may be plastic or the like, or may be constructed with different materials in different areas of the boot, such as plastic and fabric. Some examples of suitable materials for boot 12 are polyurethane and polyethylene. The boot has a main body having a toe portion 24, a heel or rear cuff portion 25, inner and outer side portions 27, 28, and is "baseless", i.e. the base is substantially completely open, with a base opening 29 extending along the majority of its length, as best illustrated in FIGS. 2 and 4. Side rims 30 extend along opposite sides of opening 29. A series of spaced fastener openings 31 are provided along each side rim 30. These openings may be recessed so that the nut or head of a fastener extending through an opening does not protrude above the upper surface of the side rim (see FIGS. 10 and 11 and associated description).

Figure 3:
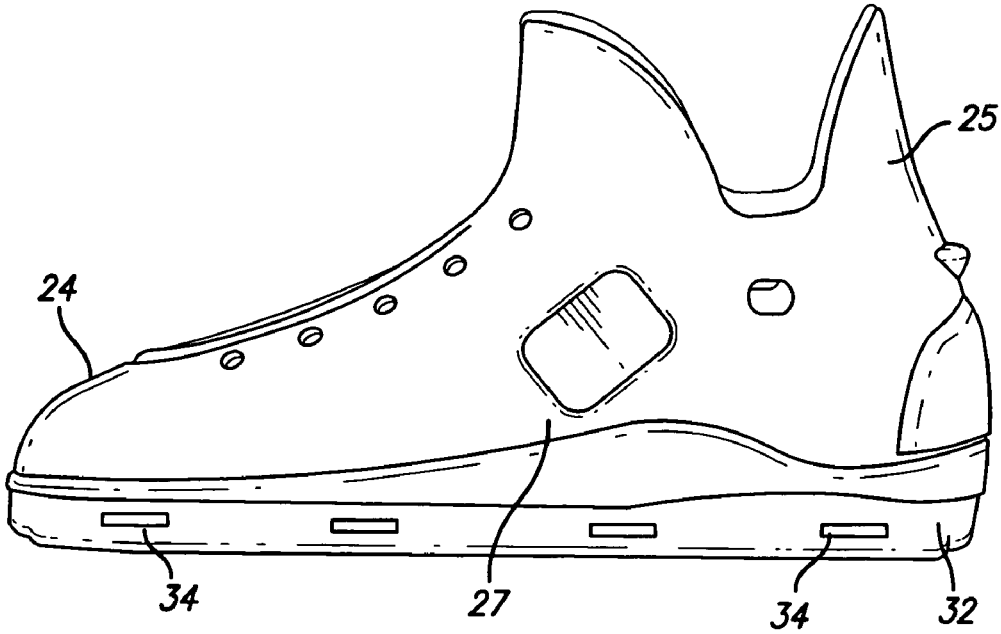
FIG. 3 is an inner side view of the boot of FIGS. 1 and 2.

A slightly recessed lower rim 32 extends around the lower periphery of the body of the boot 12, and a series of slots 34 are provided at spaced intervals along the outer and inner side edges of this rim, as best seen in FIGS. 2 and 3. A recess 35 is provided in the outer side of rim 32 for receiving the backslide plate 16.

Because skate boots are made of relatively soft material which is too flexible for direct interface with the glide frame of the skate, a rigid sole plate or frame of stronger, faster sliding material is secured over the base of the boot to provide an interface between the boot and glide frame. In this case, the boot is baseless and is open across the majority of the base region, and the sole plate 14 is secured over the base to cover the opening, as best illustrated in FIGS. 1 and 8 to 11. The sole plate may be made of any suitable hard and substantially rigid material, such as fiber reinforced nylon or the like, which will be resistant to wear and abrasion. The sole plate is releasably secured over the open base of the boot and can be removed and replaced if the surfaces become too worn over time, as a result of sliding or grinding maneuvers.

Figure 6:
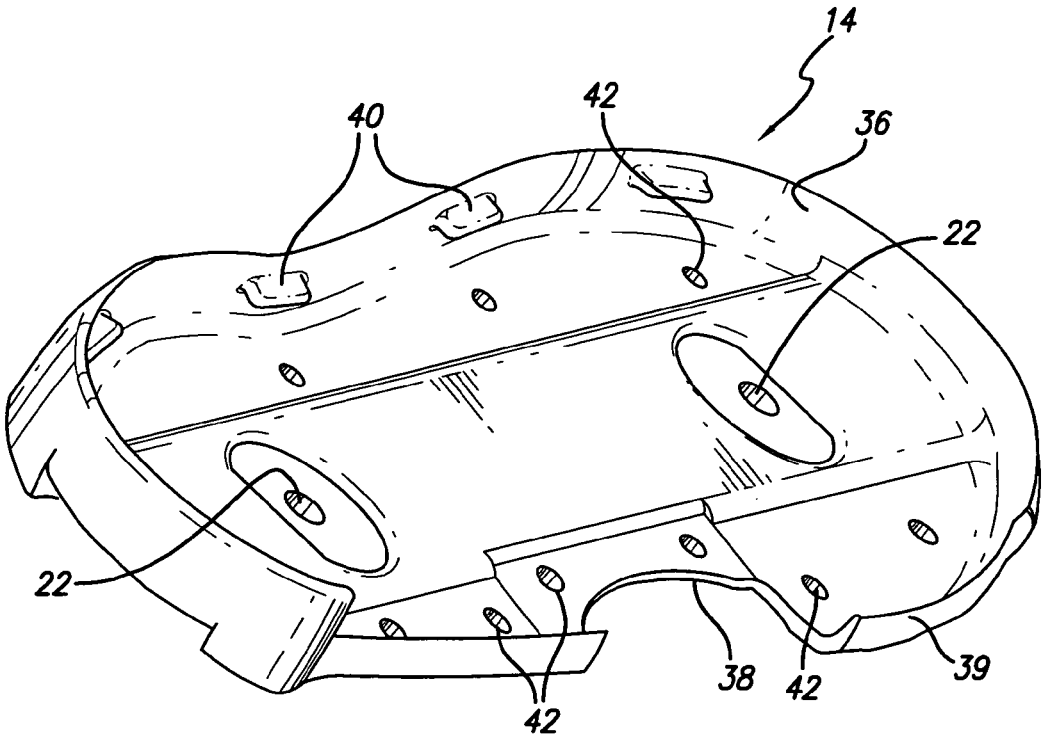
FIG. 6 is a top perspective view of the sole plate of FIG. 1.
Figure 7:
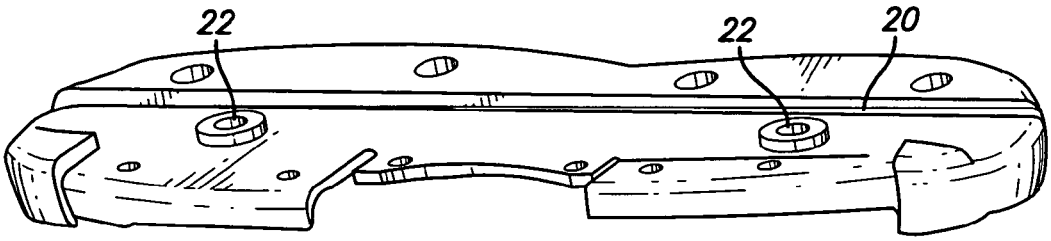
FIG. 7 is a bottom perspective view of the sole plate of FIGS. 1 and 6.

The upper and lower faces of the sole plate 14 are illustrated in more detail in FIGS. 6 and 7. The peripheral shape and dimensions of the sole plate are designed to substantially match those of the open base of the boot, and the sole plate has a raised peripheral rim 36 which extends along its inner side edge, toe, and heel. The inner side edge of the sole plate has an indent or cut out 38 for alignment with the indent 35 in the inner side of the boot which is designed to receive the backslide plate, and a reduced height rim 39 extending from the indent 38 to the toe and heel regions of the sole plate.

Figure 8:
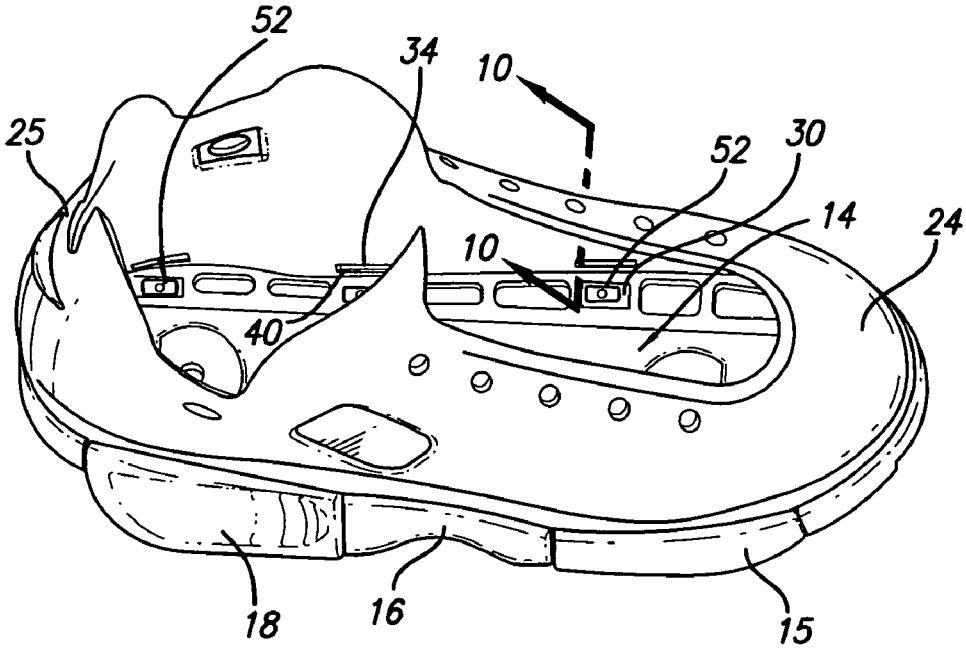
FIG. 8 is a top perspective view of the skate boot assembly with the components assembled together.
Figure 10:
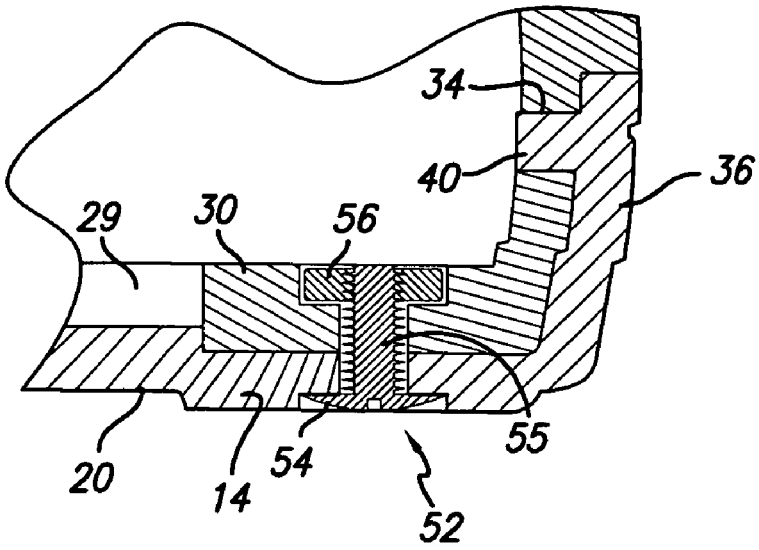
FIG. 10 is a partial cross-sectional view on the lines 10-10 of FIG. 8.

A series of four inwardly directed tabs 40 are provided on the inner side of rim 36 of the sole plate, as illustrated in FIG. 6. The tabs 40 are positioned for mating engagement in the corresponding slots 34 in the inner side rim of the boot when the sole plate is engaged over the open base of the boot, as best seen in FIGS. 8 and 10. The tabs 40 are designed to snap into the corresponding slots 34 when the sole plate is engaged over the base of the boot with the side rims 36 engaging over the corresponding rim portion 32 of the boot, as best seen in FIG. 10. Fastener openings 42 are provided along opposite side portions of the sole plate for alignment with the corresponding fastener openings 31 in the side rims 30 of the base of the boot.

Figure 5:
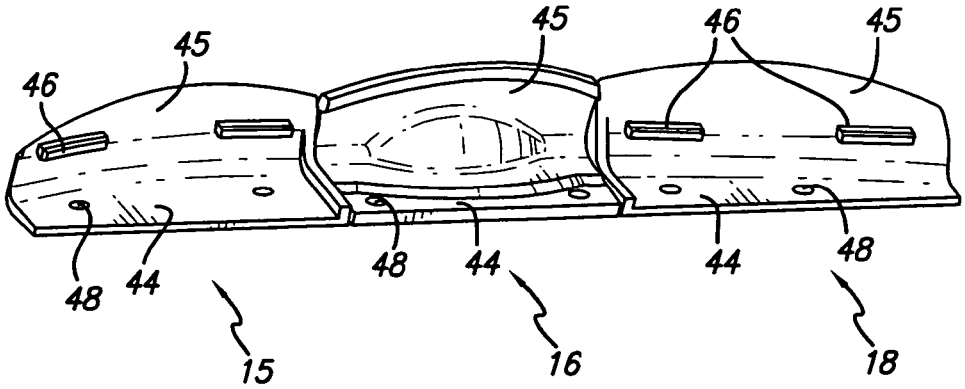
FIG. 5 is an inside perspective view of the front and rear sliders and backslide plate of FIG. 1.
Figure 9:
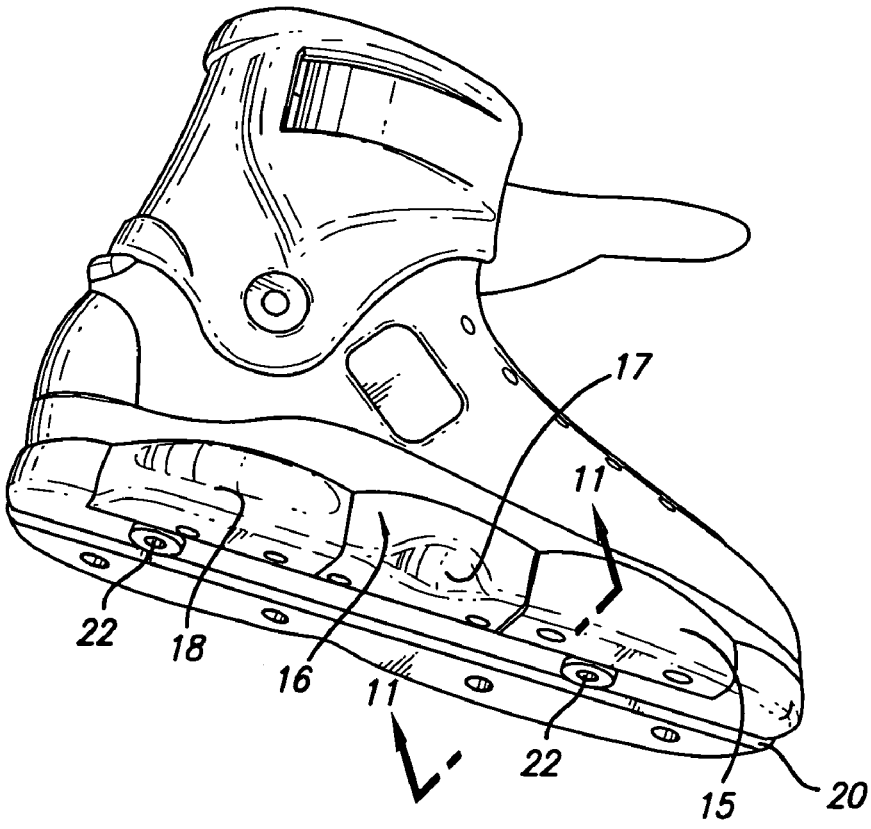
FIG. 9 is a bottom perspective view of the assembly of FIG. 8.

As illustrated in FIGS. 1, 5 and 9, a series of sliders are designed to engage over the outer side rim of the boot and the sole plate after the sole plate has been engaged over the open base of the boot. The sliders are also each made of a rigid and durable, abrasion resistant material such as fiber reinforced nylon or the like. The sliders comprise a separate front slider 15, backslide plate 16 and rear slider 18, although a single slider may be provided in alternative embodiments, or the slide surfaces may be formed integrally with the sole plate. One advantage of the separate sliders is that one or more sliders can be replaced relatively quickly and easily when they become worn. Another advantage is that the sliders help to hold the sole plate firmly in position on the base of the boot.

Backslide plate 16 has a conventional concave, arcuate slide face 17 as is known in the field. The sliders all provide hard, relatively smooth outer sliding or grinding faces, as best seen in FIG. 9, which a skater can use to slide against a suitable edge such as a rail, sidewalk edge, or the like.

Figure 11:
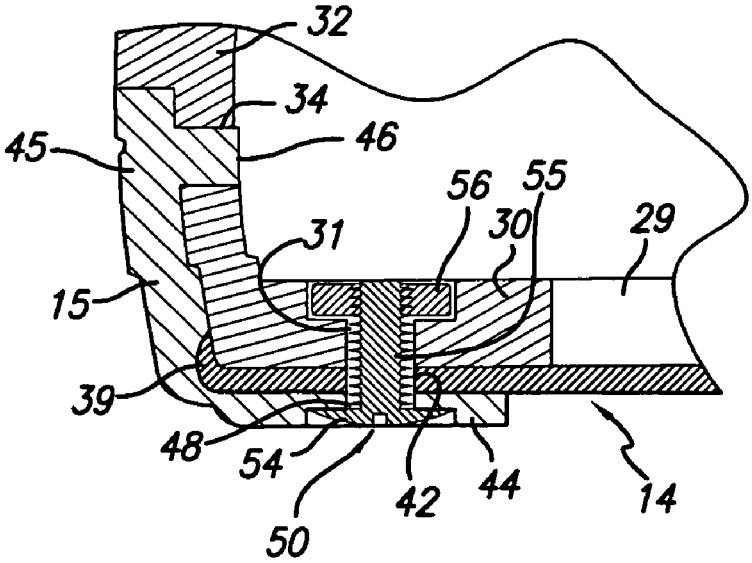
FIG. 11 is a partial cross sectional view on the lines 11-11 of FIG. 9.
Figure 12:
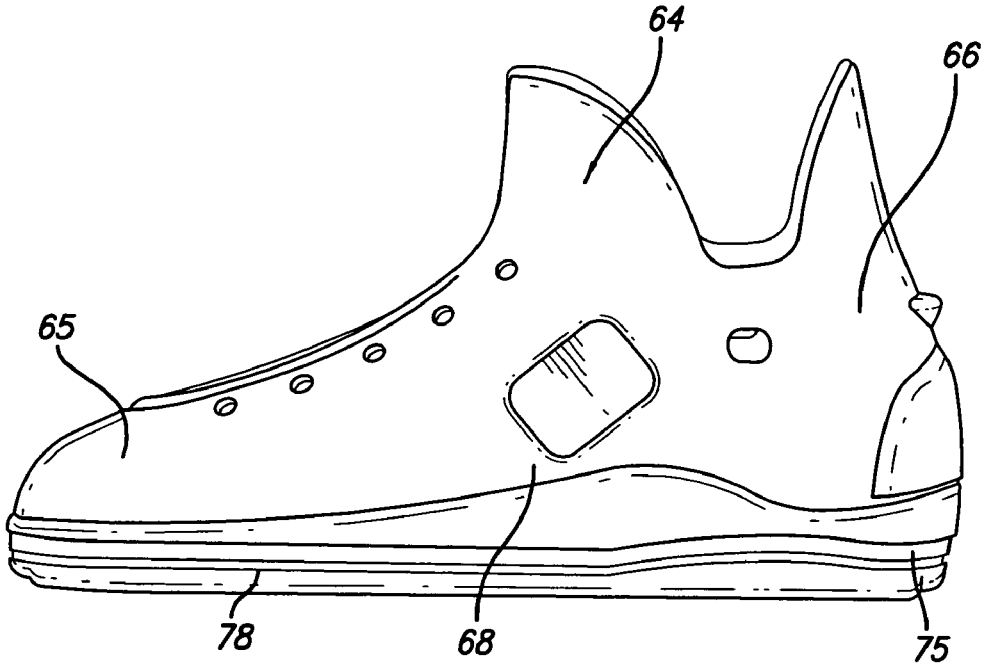
FIG. 12 is an inner side elevation view similar to FIG. 3 illustrating a boot according to another embodiment of the present invention.

Each slider is a generally L shaped member having a base wall or leg 44 and an upstanding side wall or leg 45 (see FIG. 5). The side walls of the front and rear sliders 15,18 each have two spaced, inwardly directed tabs 46 designed for mating engagement in the corresponding slots 34 in the outer side rim of the boot, as best seen in FIGS. 2, 5 and 11. The base walls of each of the sliders and the backslide plate 16 each have a pair of spaced fastener openings 48 designed for alignment with corresponding openings 31, 42 in the side rims of the base of the boot and the sole plate, respectively. FIG. 11 illustrates this alignment for one set of fastener openings in the front slider 15, sole plate 14, and side rim 30 of the base of the boot. FIG. 10 illustrates the alignment between one of the openings 31 on the opposite, inner side rim 30 and an opening 42 in the sole plate.

The respective sliders, sole plate, and outer side rim 30 of the base of the boot are secured together along the outer side of the boot by means of a first set of T-nut fasteners 50 while the sole plate and inner side rim 30 along the opposite side of the base of the boot are also secured together with a similar set of T-nut fasteners 52 extending through the aligned openings, as best seen in FIGS. 8, 10 and 11. As best illustrated in FIG. 11, each T-nut fastener of the first set comprises a bolt having a head 54 engaging in a recess surrounding the opening 48 in the respective slider and a shaft 55 extending through the aligned openings 48, 42 and 31, and a nut 56 engaging over the projecting end of shaft 55 and seated in a recess surrounding opening 31. Each fastener of the second set is of equivalent structure and like reference numerals are used for like parts, as illustrated in FIG. 10. The only difference is that the head 54 in this case engages in a recess surrounding opening 42 in the sole plate, and the shaft may be slightly shorter since it extends only through the sole plate and side rim 30.

The combination of the tongue or tab and slot engagement between the sole plate and boot on one side of the boot, and the tab and slot engagement between the sliders or grind plates and the boot on the other side of the boot, as well as the fasteners 50, 52, will firmly hold the sole plate in position over the open base of the boot. The grind plates or sliders 15,16 and 18 hold the boot and sole plate firmly together along the outside of the boot, as seen in FIG. 10, with the tab and slot engagement 34, 40 holding these parts together along the other side of the boot. The tongue and slot engagement holds the parts in the proper position with the fastener openings aligned while the fasteners 50, 52 are engaged through the openings. The fasteners 52 extending through the aligned openings on opposite sides of the boot will prevent accidental separation of these components during use of the skate.

The sole plate 14 in this embodiment has the dual function of covering the open base of the boot and also providing a strong and rigid interface between the glide or roller frame and the boot and wearer's foot. In previous skate assembly arrangements with a conventional boot base, the base of the boot and the sole plate formed a double layer between the skater's foot and the gliding surface. The arrangement of this invention has only a single layer between the wearer's foot and the glide frame, specifically the sole plate or platform, reducing the overall height of the assembly and putting the skater closer to the ground. It also provides more direct "feel" between the sole of the foot and the glide frame, potentially assisting the skater in maneuvers. The center of gravity is lowered for better stability, and the interface between the rider's foot and the glide frame is relatively rigid. The amount of material required for the boot is reduced due to its more or less completely open base, potentially reducing expense.

The sole plate and the sliders are all releasably secured to the boot, so that any one or more of these components can be removed and replaced as needed, for example if they become worn or too scuffed.

In the embodiment of FIGS. 1 to 11, the sole plate and sliders are releasably secured to the base of the boot. FIGS. 12 to 17 illustrate an alternative skate boot assembly 60 (FIG. 17) in which a rigid sole plate 62 is permanently secured to a baseless boot 64 of similar design to the previous embodiment. The boot assembly 60 also includes sliders 15, 16, and 18 similar to the sliders of the previous embodiment, and like reference numerals have been used for like parts as appropriate. The assembled view of FIG. 17 also shows the glide frame 61 and rollers 63 secured to the underside of sole plate 62, and it will be understood that a similar glide frame may be attached to the removable sole plate 14 of the previous embodiment.

Figure 13:
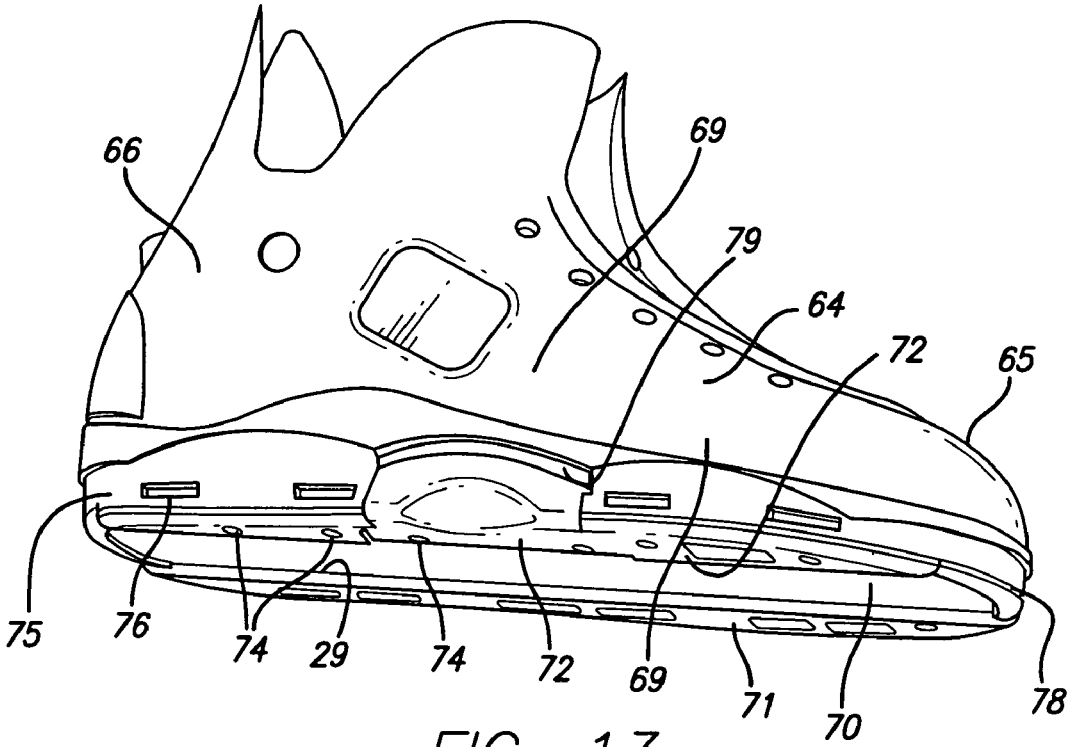
FIG. 13 is a lower perspective view of the boot of FIG. 12, illustrating the open base of the boot.

The boot and sole plate of FIGS. 12 to 17 will be made of the same or similar materials to the previous embodiment, with the boot being of generally softer, more flexible material and the sole plate 62 being of rigid, more wear-resistant material. The overall shape of the boot 64 is similar to the previous embodiment, with an upper toe portion 65, heel or cuff portion 66, and inner and outer side portion 68, 69 for receiving a wearer's foot, and a substantially open base with an opening 70 extending along substantially the entire length of the base of the boot, as best seen in FIG. 13. Opposite side rims 71, 72 extend along opposite inner and outer sides of opening 70. Unlike the previous embodiment, spaced fastener openings 74 are provided only in the outer side rim 72. The boot has a slightly recessed lower rim 75 extending around its periphery. Spaced slots 76 are provided in the outer side portion of rim, but no slots are provided on the inner side portion of the rim, unlike the previous embodiment.

A reduced thickness stitching groove 78 extends around the peripheral rim of the boot. A recessed region 79 is provided in a central region of the outer side of the rim, as in the previous embodiment, for receiving the backslide plate 18.

As in the previous embodiment, the sole plate 62 is of predetermined shape and dimensions for fitting over the open base of the boot, and has a raised peripheral rim 80 for engaging the corresponding recessed lower rim 75 of the boot. A reduced thickness stitching groove 82 extends around the rim 80 and is aligned with the groove 78 when the sole plate is placed over the base. Unlike the previous embodiments, the rim of the sole plate in this embodiment has no inwardly projecting tabs, but simply engages closely over the lower rim of the boot.

Figure 14:
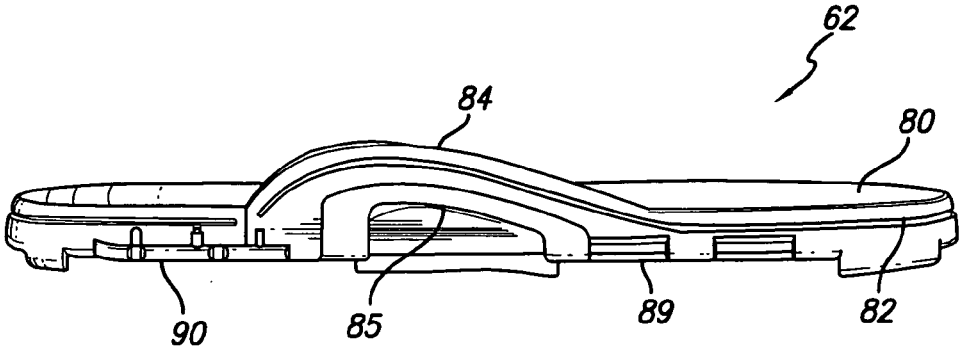
FIG. 14 is a side view of a sole plate for engagement over the open base of the boot of FIGS. 12 and 13.
Figure 15:
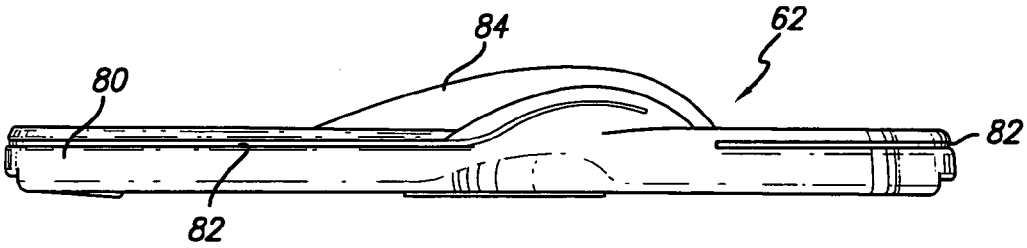
FIG. 15 is an inner side view of the sole plate of FIG. 13.
Figure 16:
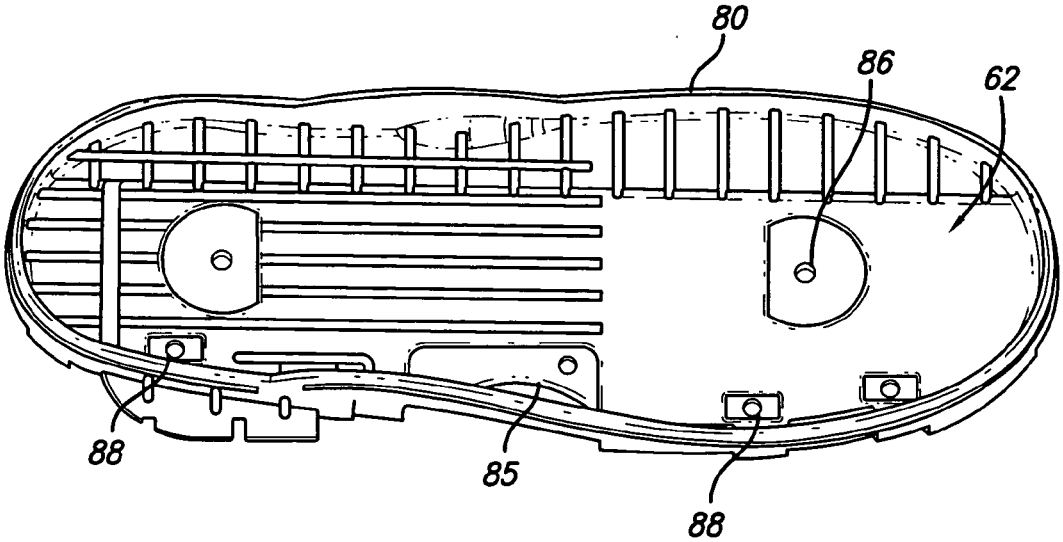
FIG. 16 is a top plan view of the sole plate of FIGS. 13 and 14.
Figure 17:
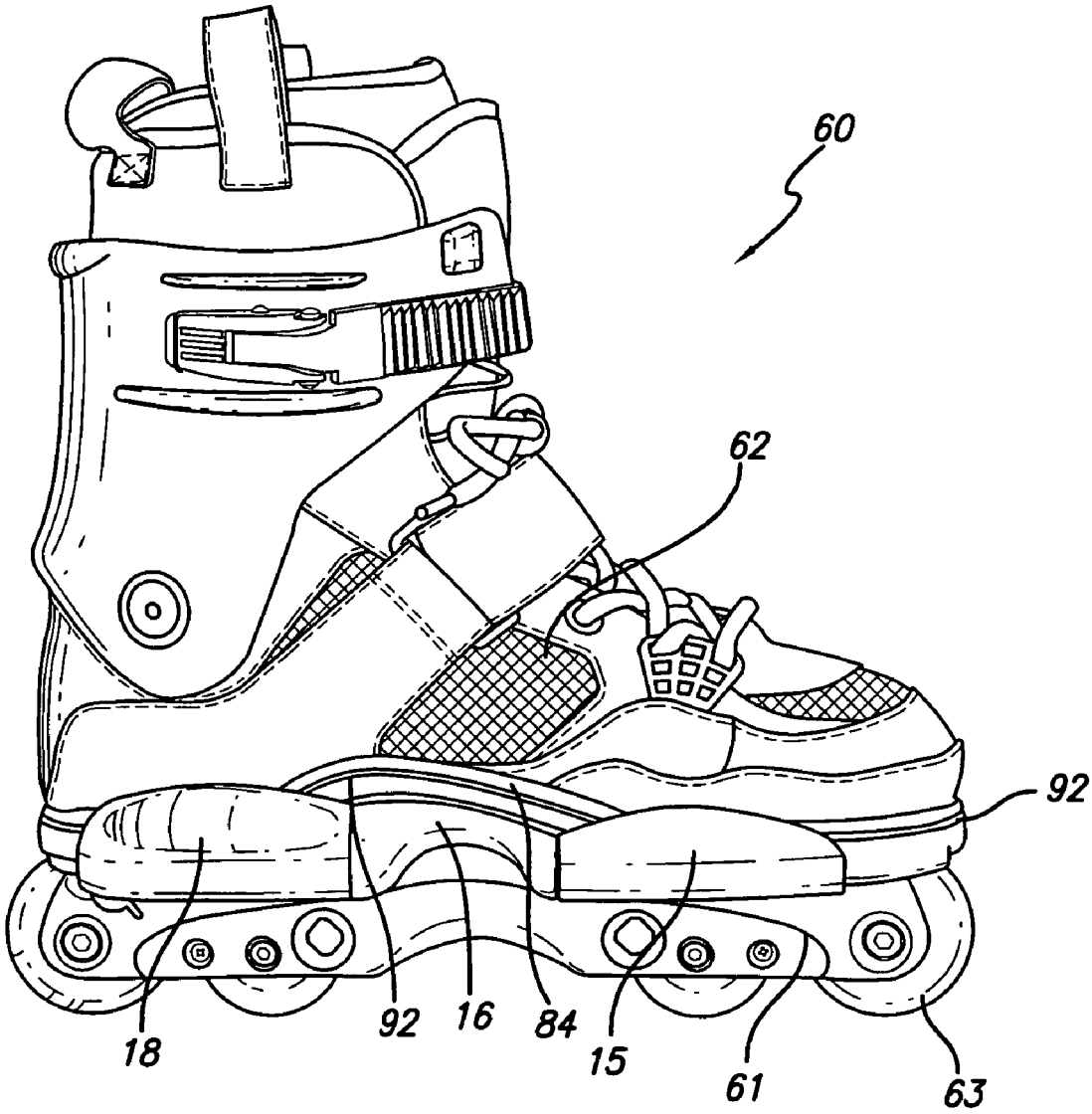
FIG. 17 is an outer side elevation view of the sole plate and boot of FIGS. 12 to 15 assembled together along with a glide device or roller frame, sliders and a back slide plate.

The peripheral rim 80 on the outer side of the sole plate has a rounded raised portion 84 with an opening 85 which will be aligned with the backslide plate recess 79 in the boot when the parts are assembled together, as can be seen in FIGS. 14 and 17. The shape of the opening corresponds to the shape of the backslide plate 16, so that plate 16 can be mounted flush in opening 85. Opening 85 extends into the base of the backslide plate 16, as can be seen in FIG. 16.

As can be seen in FIG. 16, the base plate has recessed fastener openings 86 on its center line through which a glide or roller frame 61 may be secured to the plate. Unlike the previous embodiment, additional fastener openings 88 are only provided adjacent the outer side edge of the sole plate for attachment of the sliders. Since the sole plate is permanently attached to the boot by stitching, there is no need for any additional fasteners between the boot and sole plate. The outer side of the sole plate has indents 89, 90 on its lower surface on opposite sides of the backslide plate opening 85, for receiving the front and rear sliders 15, 18 as described in more detail below. The sole plate may also have ribs and the like in its upper and/or lower surfaces for added strengthening if desired.

In this embodiment, the sole plate is placed over the open base of the boot, and the rim of the sole plate is secured to the rim of the boot by a line of stitching 92 extending through the aligned stitching grooves 75 and 82. The stitching may be wire thread or the like which is sufficiently strong to hold these parts together on a permanent or semi-permanent basis. Although the sole plate is secured to the boot by stitching in the illustrated embodiment, other securing means may be used in other embodiments such as adhesive or the like. Adhesive may be used in addition to stitching for added security.

When the sole plate is secured to the base of the boot, the fastener openings 88 along the outer side edge of the sole plate will be aligned with the fastener openings 74 in side rim 72. These are used for securing the front and rear slide plates 15, 18 and the backslide plate 16 over the outer side edge of the boot, as in the previous embodiment. As noted above, the sliders 15, 16, 18 in this embodiment will be substantially the same as in the previous embodiment, and the front and rear sliders 15, 18 will have inwardly projecting tabs 46 on their inner side walls, as illustrated in FIG. 5 in connection with the first embodiment. Additionally, fastener openings 48 will be provided in the base wall of each of the sliders 15,18 and backslide plate 16, as in FIG. 5.

In this embodiment, the backslide plate 16 is engaged through the opening 85 in the outer side of the sole plate 62, and into the recess 79 in the outer side of the boot. The front and rear sliders in turn are engaged over the outer side of the boot and sole plate on opposite sides of the backslide plate 16, with the tabs 46 projecting through slots 76 and the openings 48 aligned with the respective openings 88 and 74 in the sole plate and outer side rim of the boot respectively. Each of the sliders is secured to the boot by suitable fasteners extending through the aligned openings, such as T-nut fasteners 52 as illustrated in FIGS. 10 and 11 of the previous embodiment. The fully assembled skate is illustrated in FIG. 17.

In each of the above embodiments, a substantially "baseless" or open base skate boot is releasably or permanently secured to a sole plate of more rigid material which covers the open base of the boot. This provides rigidity at the interface between the boot and the roller or glide frame, while keeping the wearer's foot relatively close to the ground engaging wheels and not adding an extra layer of height to the assembly.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

The invention claimed is:

1. A skate assembly, comprising:

a boot having a heel, a toe, inner and outer sides, and an open base having an opening extending along at least substantially the entire length of the boot from the heel to the toe and extending completely through the base of the boot;

at least a substantial part of the boot being made of a first material; and a sole plate secured across the open base of the boot, the sole plate being made of a second material which is more rigid than the first material and having a portion which extends over and at least substantially covers the opening in the base of the boot.

2. The assembly as claimed in claim 1, wherein the sole plate is releasably attached to the boot.

3. The assembly as claimed in claim 1, wherein the open base of the boot has inner and outer side rims extending on opposite sides of the base opening.

4. The assembly as claimed in claim 3, further comprising at least one slider which engages over a first side of the boot and sole plate and provides a grinding surface to engage a sliding surface during sliding maneuvers, and at least one fastener device which secures the slider to the boot and sole plate, the slider being of a material which is more rigid than said first material.

5. The assembly as claimed in claim 1, wherein the boot has a lower peripheral rim adjacent the open base and the sole plate has a raised peripheral rim extending around at least part of its perimeter engaging over at least part of the peripheral rim of the boot.

6. The assembly as claimed in claim 1, wherein the sole plate is permanently secured over the base of the boot.

7. The assembly as claimed in claim 6, wherein the boot has a lower peripheral rim extending around the periphery of the boot, and the sole plate has a raised rim extending around at least a major part of the periphery of the sole plate which engages over the lower peripheral rim of the boot, the rim of the sole plate being permanently secured to the lower peripheral rim of the boot.

8. The assembly as claimed in claim 7, wherein the rim of the sole plate is secured to the lower peripheral rim of the boot by a line of stitching extending around the rims.

9. The assembly as claimed in claim 8, further comprising a stitching groove of reduced thickness extending around the peripheral rim of the sole plate for receiving said stitching.

10. A skate assembly, comprising:

a boot having a heel, a toe, inner and outer sides, and an open base having an opening extending along at least substantially the entire length of the boot from the heel to the toe and extending completely through the base of the boot;

at least a substantial part of the boot being made of a first material; and a sole plate secured across the open base of the boot, the sole plate being made of a second material which is more rigid than the first material; and glide device attached to the lower surface of the sole plate which is adapted for gliding movement over a surface.

11. A skate assembly, comprising:

a boot having a heel, a toe, inner and outer sides, and an open base having an opening extending along at least substantially the entire length of the boot from the heel to the toe and extending completely through the base of the boot;

at least a substantial part of the boot being made of a first material;

a sole plate secured across the open base of the boot, the sole plate being made of a second material which is more rigid than the first material;

a glide device attached to the lower surface of the sole plate; and the glide device comprising a frame and a row of rollers rotatably mounted on the frame for engaging the ground.

12. A skate assembly, comprising:

a boot having a heel, a toe, inner and outer sides, and an open base having an opening extending along at least substantially the entire length of the boot from the heel to the toe and inner and outer side rims extending on opposite sides of the base opening;

at least a substantial part of the boot being made of a first material; and a sole plate secured across the open base of the boot, the sole plate being made of a second material which is more rigid than the first material and having a portion which extends over and at least substantially covers the opening in the base of the boot; and the side rims extending on opposite sides of the base opening having fastener openings, the sole plate having corresponding fastener openings which are aligned with the side rim openings, and releasable fastener devices extending through the aligned openings which releasably secure the sole plate to the boot.

13. A skate assembly, comprising:

a boot having a heel, a toe, inner and outer sides, and an open base having an opening extending along at least substantially the entire length of the boot from the heel to the toe;

at least a substantial part of the boot being made of a first material;

a sole plate secured across the open base of the boot, the sole plate being made of a second material which is more rigid than the first material and having a portion which extends over and at least substantially covers the opening in the base of the boot; and the boot and sole plate having peripheral rims which have spaced mateable formations extending along at least one side of the boot for releasable engagement when the sole plate is engaged over the open base of the boot.

14. The assembly as claimed in claim 13, wherein the mateable formations extend along only one side of the boot.

15. The assembly as claimed in claim 13, wherein the mateable formations extend along the inner side of the boot, and at least one slider engages over the outer side of the boot and under an adjacent portion of the sole plate, the slider and an adjacent portion of the peripheral rim of the boot having mateable formations which releasably secure the slider to the boot and retain the adjacent portion of the sole plate over the base of the boot.

16. The assembly as claimed in claim 15, wherein the base of the boot has inner and outer side rims extending on opposite sides of the base opening, first fastener devices releasably secure the sole plate to the inner side rim of the base and at least one second fastener device releasably secures the slider to the sole plate and the outer side rim of the base of the boot.

17. A skate assembly, comprising:

a boot having a heel, a toe, inner and outer sides, and an open base having an opening extending along at least substantially the entire length of the boot from the heel to the toe;

at least a substantial part of the boot being made of a first material, a sole plate secured across the open base of the boot, the sole plate being made of a second material which is more rigid than the first material;

the boot and sole plate having peripheral rims which have spaced mateable formations extending along at least one side of the boot for releasable engagement when the sole plate is engaged over the open base of the boot; and the formations on one of the rims comprising projecting tabs and the formations on the other rim comprise openings for receiving the tabs.

18. A skate assembly, comprising:

a boot having a heel, a toe, inner and outer sides, and an open base having a lower face, the base having an opening extending along at least substantially the entire length of the boot from the heel to the toe and inner and outer side rims extending along opposite sides of the opening;

at least a substantial part of the boot being made of a first material;

a sole plate secured over the lower face of the open base of the boot, the sole plate being made of a second material which is more rigid than the first material; and at least one slider separate from the sole plate which engages over a first side of the boot and sole plate and provides a grinding surface which is adapted to engage and slide along a sliding surface during sliding maneuvers, and at least one fastener device which secures the slider to the boot and sole plate, the slider being of a material which is more rigid than said first material;

the slider being generally L shaped and having a base portion which extends under the adjacent base side rim and sole plate and a side wall portion which extends upwardly over a lower peripheral rim of the side of the boot.

19. The assembly as claimed in claim 18, wherein the adjacent base side rim has a first fastener opening, the sole plate has a second opening aligned with said first fastener opening, and the base portion of the slider has a third opening aligned with said first and second openings, the fastener device extending through said aligned openings to secure the slider and sole plate to the open base of the boot.

20. The assembly as claimed in claim 18, wherein the lower portion of the side of the boot and the side wall portion of the slider have mating formations for releasable engagement to secure the slider to the boot.

21. The assembly as claimed in claim 20, wherein said fastener device releasably secures the base portion of the slider to the sole plate and side rim of the base opening, whereby the mating formations between the slider side wall portion and side of the boot and the fastener device together secure the sole plate to the boot.

22. A skate assembly, comprising:

a boot having a heel, a toe, inner and outer sides, and an open base having an opening extending along at least substantially the entire length of the boot from the heel to the toe and inner and outer side rims extending along opposite sides of the opening;

at least a substantial part of the boot being made of a first material;

a sole plate secured across the open base of the boot, the sole plate being made of a second material which is more rigid than the first material; and at least one slider which engages over a first side of the boot and sole plate and provides a grinding surface to engage a sliding surface during sliding maneuvers, and at least one fastener device which secures the slider to the boot and sole plate, the slider being of a material which is more rigid than said first material;

the slider being generally L shaped and having a base portion which extends under the adjacent base side rim and sole plate and a side wall portion which extends upwardly over a lower peripheral rim of the side of the boot;

the lower portion of the side of the boot and the side wall portion of the slider have mating formations for releasable engagement to secure the slider to the boot; and the lower portion of the side of the boot having a slot and the side wall portion of the slider having a tab for releasable mating engagement in the slot.

23. A skate assembly, comprising:

a boot having a heel, a toe, inner and outer sides, and an open base, the base having a lower face, an opening extending along at least substantially the entire length of the boot from the heel to the toe and inner and outer side rims extending along opposite sides of the opening;

at least a substantial part of the boot being made of a first material;

a sole plate secured over the lower face of the open base of the boot, the sole plate being made of a second material which is more rigid than the first material;

a first slider which engages over a first side of the boot and sole plate and provides a grinding surface adapted to engage a sliding surface during sliding maneuvers, and at least one fastener device which secures the slider to the boot and sole plate, the slider being of a material which is more rigid than said first material; and a second slider spaced from the first slider which engages over the first side of the boot and sole plate, and a second fastener device which releasably secures the second slider to the boot and sole plate.

24. The assembly as claimed in claim 23, further comprising a third slider which engages over the first side of the boot and sole plate between the first and second sliders, the third slider comprising a backslide plate having an arcuate outer slide surface.

25. The assembly as claimed in claim 23, wherein the first and second sliders each have a base portion which extends under an adjacent side portion of the sole plate and a side wall portion extending upwardly from the base portion over an adjacent portion of the side of the boot, the first and second fastener devices releasably securing the base portions of each slider to the sole plate and side rim of the boot base opening, and each slider having an additional fastener device which releasably secures the respective side wall portion to an adjacent portion of the side of the boot, whereby the sliders secure the adjacent side portion of the sole plate to the boot.

* * * * *

UNITED STATES PATENT AND TRADEMARK OFFICE

CERTIFICATE OF CORRECTION

PATENT NO. : 7,594,666 B2
APPLICATION NO. : 11/451901
DATED : September 29, 2009
INVENTOR(S) : Andreas C. Wegener It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 552 days.

Signed and Sealed this

Twenty-eighth Day of September, 2010

David J. Kappos

David J. Kappos
*Director of the United States Patent and Trademark Office*